United States Patent [19]

Schoeff et al.

[11] Patent Number: 4,878,481

[45] Date of Patent: Nov. 7, 1989

[54] FIREPLACE HAVING CHIMNEY CONSTRUCTION INCLUDING COLD AIR BARRIER

[75] Inventors: Terry G. Schoeff, Andrews; Rex A. Kaufman, Roanoke, both of Ind.

[73] Assignee: Majco Building Specialites, L.P., Huntington, Ind.

[21] Appl. No.: 295,128

[22] Filed: Jan. 9, 1989

[51] Int. Cl.[4] ..... F23L 17/02

[52] U.S. Cl. ..... 126/307 R; 126/312; 98/60

[58] Field of Search ..... 126/85 B, 85 R, 307 R, 126/312, 314, 315, 531, 515; 98/48, 58, 60

[56] References Cited

U.S. PATENT DOCUMENTS 2,718,841 9/1955 Kinkead ..... 126/307 R
2,898,839 8/1959 McKann ..... 126/85 B
4,108,144 8/1978 Wilhoite ..... 126/85 B
4,608,963 9/1986 Townsend ..... 126/307 R

*Primary Examiner*—James C. Yeung
*Attorney, Agent, or Firm*—Hoffmann & Baron

[57] ABSTRACT

A fireplace and chimney assembly is provided which includes a two wall chimney construction and a termination shield for reducing the amount of cold air which can radiate into a living area. The termination shield encompasses the base of the chimney construction while providing sufficient open area for cooling air to be drawn into the annular space within the two wall chimney construction. A false ceiling is installed above the shield. A firestop is provided therein for receiving the top end of the shield. The assembly prevents cold air from dropping into the chase cavity around the fireplace when the fireplace is not in use.

12 Claims, 1 Drawing Sheet

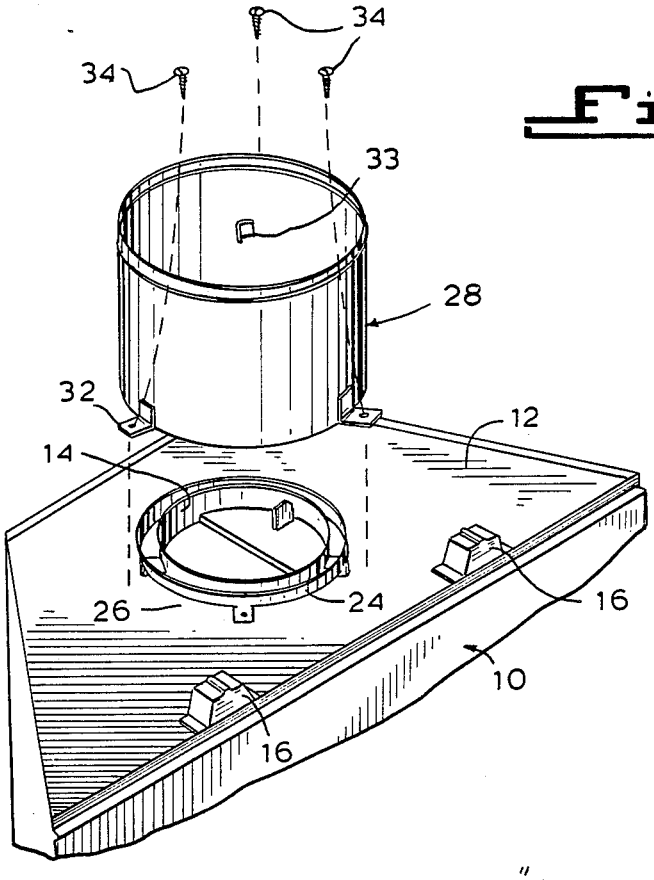
Fig. 1
Fig. 3
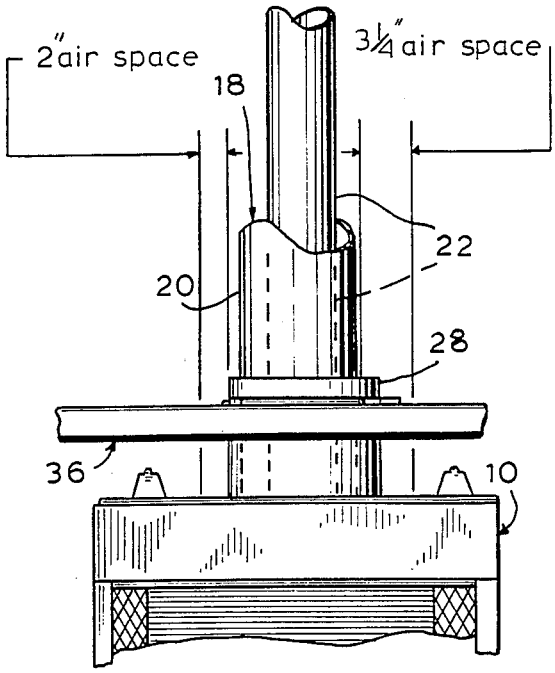
Fig. 2
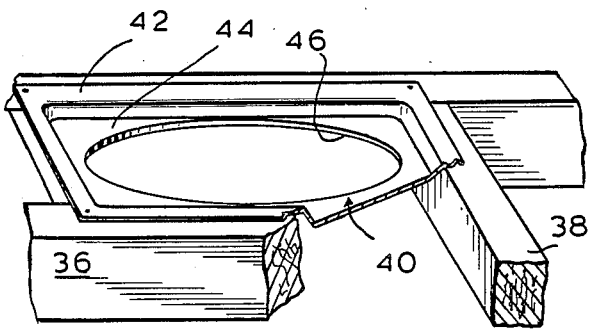

FIREPLACE HAVING CHIMNEY CONSTRUCTION INCLUDING COLD AIR BARRIER

BACKGROUND OF THE INVENTION

The field of the invention relates to chimney constructions for prefabricated fireplaces and the like.

There are a number of chimney constructions which are available for use with factory built fireplaces. U.S. Pat. Nos. 4,082,322, 4,236,498, 4,259,941, 4,271,815, 4,466,340 and 4,700,687 disclose a number of such fireplaces and chimney constructions associated therewith. Generally speaking, two of the more popular types of chimney constructions can be described as two wall and three wall systems.

Two wall chimney constructions are generally less expensive taen three wall constructions. They include two concentric pipes which are mounted to the fireplace and extend through the roof of the building. The inner pipe functions as a flue pipe and is made from stainless steel or other heat-resistant material. The outer pipe is made from steel and may have a galvanized outer surface. Such systems operate by pulling in cooling air from the base of the chimney through a turnaround assembly. The area surrounding the fireplace is referred to as the enclosure cavity. The cooling air flows upwardly between the two pipes when the fireplace is in use, thereby continuously removing heat. The "turnaround assembly" defined by an outer collar, is provided at the top of the fireplace to allow such an air flow. In contrast, three wall systems include three concentric pipes and operate by means of thermal siphoning. Cooling air is taken from the outside rather than the enclosure cavity and is drawn down between the outer and middle pipes. The air is expelled up and out from between the middle and flue pipes by natural convection.

SUMMARY OF INVENTION

It is a principal object of the invention to provide a fireplace and two wall chimney assembly which prevents cold air from filtering into the enclosure cavity around a fireplace. The assembly includes a termination shield which is mounted to the top wall of the fireplace and extends into a ceiling above the fireplace. The two wall chimney is mounted to the fireplace and positioned within the termination shield. Cold air which may drop within the annular space defined by the double wall chimney is substantially trapped by the termination shield when the fireplace is not in use, thereby preventing cold air from radiating into a living area. When the fireplace is in use, the termination shield provides sufficient open area for cooling air which is drawn between the concentric walls of the two wall chimney and travels upwardly therein.

The termination shield is preferable cylindrical in construction and is substantially shorter in length than the two wall chimney. Cool air escaping from the base of the chimney is substantially trapped within the shield and above the ceiling. Since the latter can be insulated, the cool air should not significantly affect the living area about the fireplace.

BRIEF DESCRIPTION OF THE DRAWINGS

FIG. 1 is a perspective view showing the mounting of a termination shield upon a fireplace;

FIG. 2 is a top perspective view showing a portion of a ceiling including a firestop spacer;

FIG. 3 is a front elevation view illustrating a fireplace having a termination shield and a two wall chimney mounted thereto.

DETAILED DESCRIPTION OF THE INVENTION

The invention relates to a fireplace and two wall chimney assembly which is designed to reduce the amount of cold air which could potentially enter the living area of the home.

A factory constructed fireplace 10 including a substantially flat top wall 12, a flue opening 14 within the top wall, and a pair of standoffs 16 is shown in FIG. 1. Such fireplaces are commonly used in residential and mobile homes.

Referring to FIG. 3, a two wall chimney 18 is mounted to the fireplace 10 and extends substantially vertically with respect thereto. The chimney includes outer and inner concentric, cylindrical walls 20, 22, and inner wall 22 being secured to the walls defining the flue opening. An outer collar 24 is secured to the top wall 12 of the fireplace. The top wall and collar define a plurality of longitudinal slots 26. The outer wall 20 is mounted to the outer collar 24 in such a manner that cooling air is able to enter the annular space defined between the inner and outer walls through the slots 26. The upflow of air through this space cools the chimney when the fireplace is in operation. The inner wall, which is generally referred to as the flue pipe, is made from steel and preferably includes a galvanized outer surface.

The fireplace and chimney as described above functions satisfactorily when in use. Heat is continuously removed from the assembly via the upward movement of cooling air which is drawn between the fireplace and outer pipes through the slots 26. In colder climates, however, cold air will drop through annular space between the chimney pipes when the fireplace is not in use. This air will tend to accumulate in the "enclosure cavity" at the top of the fireplace and eventually radiate into the living area.

Referring again to FIGS. 1 and 3, a termination shield 28 including a cylindrical body 30, three mounting brackets 32 and a plurality of internal projections 33 is mounted to the top wall 12 of the fireplace. Three screws 34 are provided for securing the shield to the top wall 12 such that the base thereof is in substantial sealing engagement with the top wall. The shield may be made from galvanized steel or other appropriate material. It is preferably less than two feet in height, the preferred range being ten to fifteen inches.

The area above the fireplace is framed and firestopped in the same manner as a ceiling. A false ceiling 36 is preferably installed about five inches above the standoffs 16. The chimney hole is framed as shown in FIG. 2 with lumber about the same size as the joists 38. A minimum air space to combustibles is provided between the outside surface of the termination shield and the edges of the chimney hole.

A firestop spacer 40 is installed over the chimney hole to provide the required air space between combustibles and the termination shield. The spacer includes a peripheral flange 42 which rests upon the joists and frame members and a recessed portion 44 through which a chimney opening 46 extends. Once the firestop spacer 40 is secured in place, the two wall chimney 18 can be installed, starting at the first actual ceiling level (not shown). The completed assembly is shown in FIG. 3. The clearance between the shield 28 and the opening 46 is small to prevent cold air from readily passing from above the false ceiling 36 to the enclosure cavity. The projection 33 extending from the inner surface of the shield 28 facilitates the installation of the chimney.

When the fireplace is in use, air will tend to flow upwardly between the shield 28 and the outer chimney wall 20. When not in use, cold air which may drop between the chimney walls is retained within the shield and will accordingly tend to dissipate in the cavity above the false ceiling 36. The ceiling is preferable insulated, thereby minimizing the effects of the cold air trapped thereabove.

What is claimed is:

1. A fireplace and chimney assembly comprising:

a fireplace housing including a top wall and an opening within said top wall;

a two wall chimney construction mounted to said top wall of said fireplace housing, said chimney construction including an inner cylindrical wall extending from said opening and an outer cylindrical wall positioned concentrically with respect to said inner cylindrical wall, said outer wall including a base portion positioned adjacent to said top wall of said fireplace housing;

an annular space defined by the inner surface of said outer wall and the outer surface of said inner wall;

means for introducing cooling air into said annular space near said base portion of said outer wall;

ceiling means positioned a selected distance above said top wall of said fireplace housing; and a shield including walls defining a bottom opening; a top opening, and a space extending between said bottom and top openings, said shield being mounted to said top wall of said fireplace such that said bottom opening is substantially sealed by said top wall, said shield walls including inner and outer surfaces, said outer surfaces of said shield walls being in substantially sealing engagement with said ceiling means; said inner surfaces of said shield and said outer surface of said outer wall defining a second space from which cooling air may be introduced into said annular space, said shield being substantially shorter in length than said inner and outer cylindrical walls.

2. An assembly as defined in claim 1 wherein said shield includes cylindrical walls and is mounted substantially concentrically with respect to said inner and outer cylindrical walls.

3. An assembly as defined in claim 2 wherein said shield has a length of less than two feet.

4. An assembly as defined in claim 3 wherein said shield extends slightly through said ceiling means.

5. An assembly as defined in claim 4 wherein said ceiling means include a false ceiling.

6. An assembly as defined in claim 3 wherein said length is ten to fifteen inches.

7. An assembly as defined in claim 2 including a firestop mounted to said ceiling, said firestop including a circular opening extending therethrough, said shield extending slightly through said circular opening.

8. An assembly as defined in claim 2 wherein said means for introducing cooling air into said annular space includes an outer collar mounted to said top wall of said fireplace housing, said base portion of said outer cylindrical wall being secured to said outer collar, and a passage extending beneath said outer collar and above said top wall of said fireplace housing, said passage being in fluid communication with said annular space.

9. An assembly as defined in claim 8 wherein said ceiling means include a false ceiling.

10. An assembly as defined in claim 2 wherein said shield extends slightly through said ceiling means.

11. An assembly as defined in claim 10 wherein said ceiling means include a false ceiling.

12. An assembly as defined in claim 1 wherein said ceiling means include a false ceiling.

* * * * *